US009815654B2

(12) United States Patent
Shishikura

(10) Patent No.: US 9,815,654 B2
(45) Date of Patent: Nov. 14, 2017

(54) SHEET PROCESSING SYSTEM AND SHEET PROCESSING METHOD

(71) Applicant: Kabushiki Kaisha Toshiba, Tokyo (JP)

(72) Inventor: Masahiro Shishikura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/061,589

(22) Filed: Mar. 4, 2016

(65) Prior Publication Data

US 2017/0066617 A1 Mar. 9, 2017

(30) Foreign Application Priority Data

Sep. 8, 2015 (JP) ..... 2015-176626

(51) Int. Cl.

| | |
|---|---|
| ***B07C 5/00*** | (2006.01) |
| ***B65H 29/62*** | (2006.01) |
| ***B65H 1/06*** | (2006.01) |
| ***B65H 3/06*** | (2006.01) |
| ***B65H 29/00*** | (2006.01) |

(Continued)

(52) U.S. Cl.

CPC ..... *B65H 29/62* (2013.01); *B07C 5/34* (2013.01); *B65H 1/06* (2013.01); *B65H 3/063* (2013.01); *B65H 5/002* (2013.01); *B65H 7/06* (2013.01); *B65H 29/001* (2013.01); *B65H 43/04* (2013.01);

(Continued)

(58) Field of Classification Search

CPC . B07C 5/00; G07D 7/00; G07D 11/00; G07D 11/0033; G07D 11/0072; G07D 11/0081; G07F 7/04; G07F 19/00; B07D 11/0084; B65H 1/06; B65H 3/063; B65H 5/002; B65H 7/06; B65H 29/001; B65H 43/04; B65H 2701/1912

See application file for complete search history.

(56) References Cited

U.S. PATENT DOCUMENTS 5,012,932 A 5/1991 Omura et al.
5,247,159 A * 9/1993 Yuge ..... G07D 11/0075 209/534

(Continued)

FOREIGN PATENT DOCUMENTS

EP 0302458 A2 2/1989
JP 2001-243519 A 9/2001

(Continued)

*Primary Examiner* — Mark Beauchaine
(74) *Attorney, Agent, or Firm* — Baker Botts L.L.P.

(57) ABSTRACT

A sheet processing system comprising:
a sheet processing apparatus; and
a sheet counting apparatus,
wherein the sheet processing apparatus includes:
a conveying unit for conveying a sheet to be processed;
a determination device for determining the sheet conveyed by the conveying unit; and
an accumulation unit for accumulating a rejected sheet on the basis of a determination result given by the determination unit,
wherein the sheet counting apparatus includes a counting device for counting the paper sheet, and the paper sheet counting apparatus counts the rejected sheet accumulated on the accumulation unit of the sheet processing apparatus, and having a transmitting unit that transmits an information about the counting result to a receiving unit of the paper sheet processing apparatus.

10 Claims, 10 Drawing Sheets

(51) Int. Cl.

| | |
|---|---|
| ***B65H 43/04*** | (2006.01) |
| ***B07C 5/34*** | (2006.01) |
| ***B65H 5/00*** | (2006.01) |
| ***B65H 7/06*** | (2006.01) |
| ***G07D 11/00*** | (2006.01) |

(52) U.S. Cl.
CPC .. *G07D 11/0084* (2013.01); *B65H 2701/1912* (2013.01)

(56) References Cited

U.S. PATENT DOCUMENTS

| | | | | |
|---|---|---|---|---|
| 8,327,994 | B2 * | 12/2012 | Kayani | G07D 11/0084 194/206 |
| 9,315,355 | B2 * | 4/2016 | Aoji | B65H 31/24 |
| 2006/0163027 | A1 | 7/2006 | Hobmeier et al. | |
| 2014/0238815 | A1 | 8/2014 | Iwamura et al. | |
| 2016/0196708 | A1 * | 7/2016 | Doi | G06Q 20/10 194/206 |

FOREIGN PATENT DOCUMENTS

| | | | |
|---|---|---|---|
| KR | 19910009118 | B1 | 10/1991 |
| RU | 2315359 | C2 | 1/2006 |

* cited by examiner

SHEET PROCESSING SYSTEM AND SHEET PROCESSING METHOD

CROSS-REFERENCE TO RELATED APPLICATIONS

This application is based upon and claims the benefit of priority from the prior Japanese Patent Applications No. 2015-176626 filed on Sep. 8, 2015, the entire contents of which are incorporated herein by reference.

FIELD

Embodiments of the present invention relate to a sheet processing system and a sheet processing method.

BACKGROUND

In the past, a paper sheet processing apparatus for classifying paper sheets such as banknotes on the basis of the type and the degree of damage is known.

This paper sheet processing apparatus classifies a processing target paper sheet into a processed bill and a rejected bill on the basis of, for example, a determination result of a paper sheet and a conveying state of a paper sheet in an apparatus. However, in the past, in a case where rejected bills are counted manually by a person, the processing efficiency of the paper sheet may be reduced.

DETAILED DESCRIPTION

A sheet processing method and a sheet processing system according to the embodiment will be hereinafter explained with reference to drawings.

First Embodiments

Figure 1:
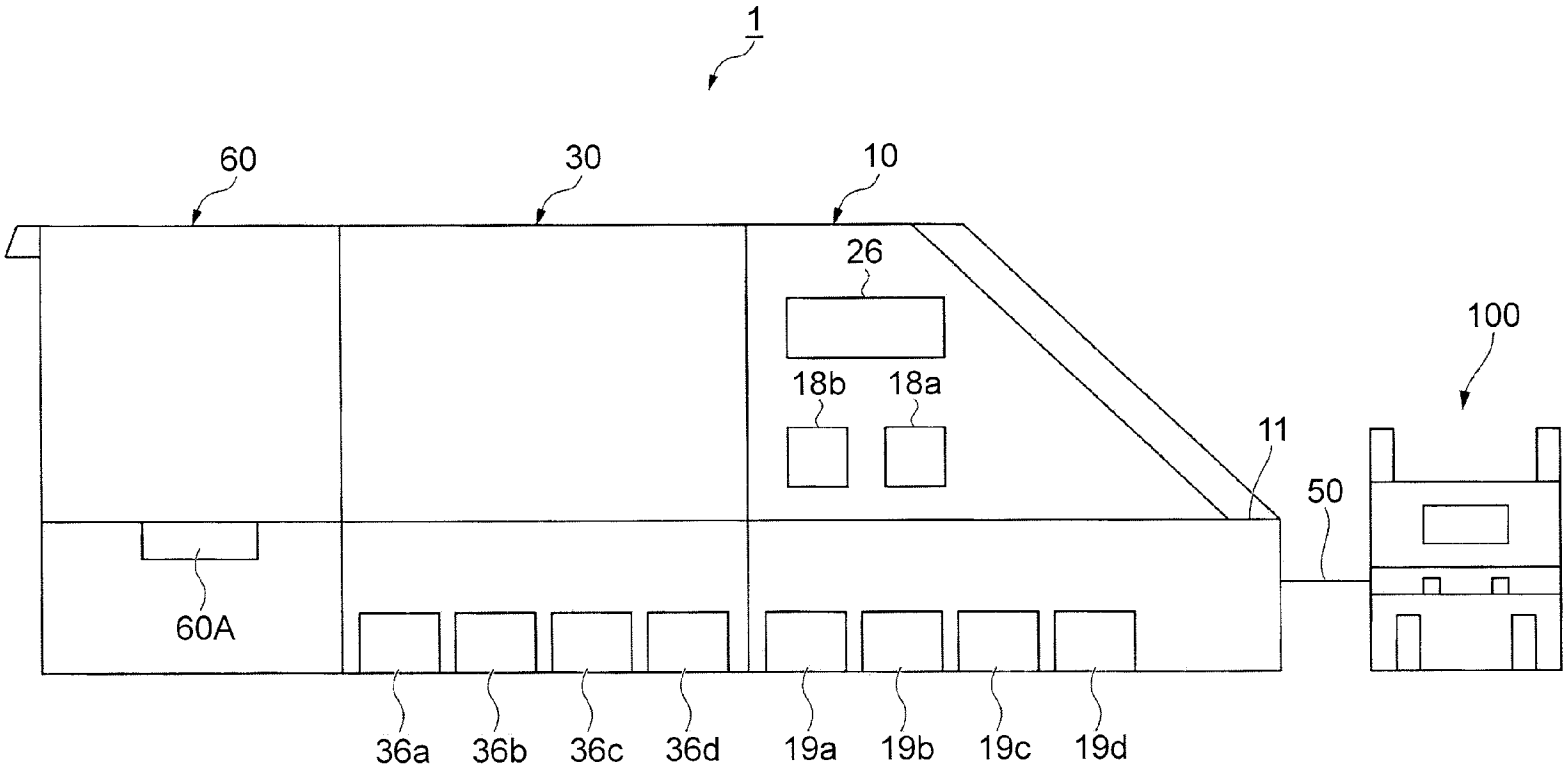
FIG. 1 is a figure schematically illustrating an entire configuration of a paper sheet processing system according to a first embodiment.

FIG. 1 is a figure schematically illustrating an entire configuration of a paper sheet processing system according to an embodiment.

A paper sheet P to be processed by a paper sheet processing apparatus 1 is, for example, a banknote, but the paper sheet processing apparatus 1 may process paper sheets P other than a banknote such as mails or various kinds of cards or tickets.

The paper sheet processing system includes a paper sheet processing apparatus 1 and a paper sheet counting apparatus 100.

The paper sheet processing apparatus 1 and the paper sheet counting apparatus 100 are connected by a communication cable 50. The communication cable 50 is a communication line capable of transmitting and receiving information, and is, for example, a USB (Universal Serial Bus) cable or a serial cable. The paper sheet processing apparatus 1 and the paper sheet counting apparatus 100 are connected in a higher level, and rejected bill information is added to a processing result of the paper sheet processing apparatus. The paper sheet processing apparatus 1 is, for example, middle-sized paper sheet processing apparatus, and the paper sheet counting apparatus 100 is an apparatus smaller than the paper sheet processing apparatus. The embodiment is characterized in a system operation made by combining the paper sheet processing apparatus 1 and the paper sheet counting apparatus 100.

The paper sheet processing apparatus 1 includes, for example, a main module 10, an aligning module 30, and a sealing module 60. The main module 10, the aligning module 30, and the sealing module 60 are aligned and arranged in a row in this order. The main module 10, the aligning module 30, and the sealing module 60 are electrically and mechanically coupled with each other.

The main module 10 includes, for example, a monitor 26, rejection units 18*a* and 18*b*, and accumulation cases 19*a*, 19*b*, 19*c*, and 19*d*. The monitor 26 is, for example, an LCD (Liquid Crystal Display) or an organic EL (Electroluminescence) display apparatus. The rejection units 18*a* and 18*b* are loading cassettes in which paper sheets P removed by the paper sheet processing apparatus 1 are accumulated. The accumulation cases 19*a*, 19*b*, 19*c*, and 19*d* are loading cassettes in which paper sheet P processed by the paper sheet processing apparatus 1 are accumulated. The aligning module includes multiple accumulation cases 36*a*, 36*b*, 36*c*, and 36*d*. The paper sheets P processed by the aligning module 30 are accumulated on the accumulation cases 36*a*, 36*b*, 36*c*, and 36*d*. The sealing module 60 includes a take out port 60A. A bundle of 100 banknotes which have been subjected to sealing processing by the sealing module 60 is conveyed to the retrieval port 60A. The paper sheets P conveyed to the rejection units 18*a* and 18*b*, the accumulation cases 19*a*, 19*b*, 19*c*, and 19*d*, the accumulation cases 36*a*, 36*b*, 36*c*, and 36*d*, and the retrieval port 60A can be retrieved by, for example, an operator.

Figure 2:
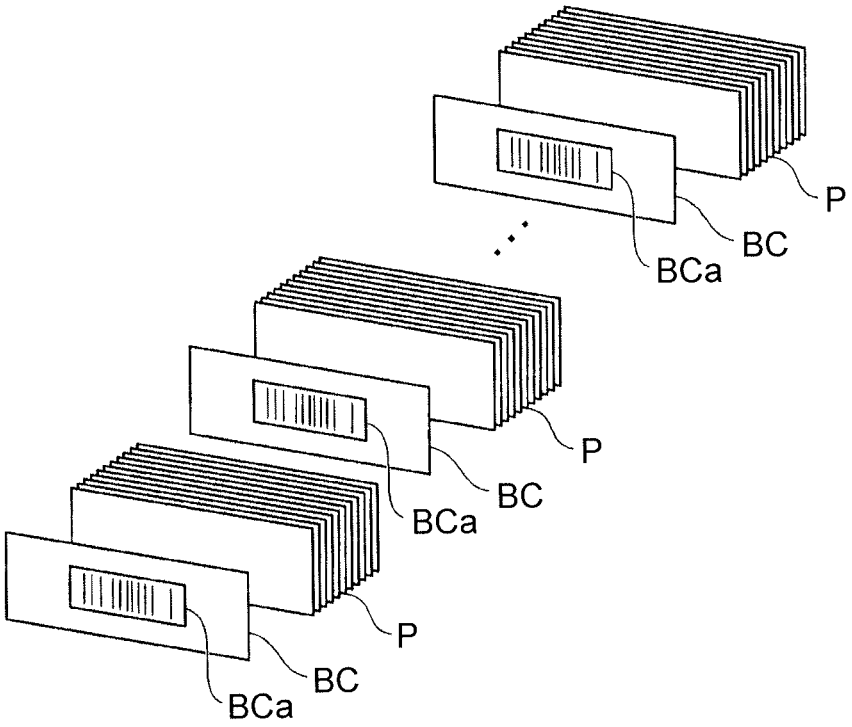
FIG. 2 is a configuration diagram illustrating a paper sheet P of processing target.

FIG. 2 is a configuration diagram illustrating paper sheets P of processing target. Multiple paper sheets P are accumulated on the thickness direction of the paper sheets P and contained in the supply unit 11. A batch card BC (storage medium) may be sandwiched in multiple paper sheets P. The batch card BC is formed to have, for example, the same external diameter dimension as the paper sheet P, and is made by printing a bar code BCa on a paper base material. For example, a batch card number, an account number, and a total quantity of counting of the paper sheets P are encoded in the bar code BCa. The total quantity of counting of the paper sheets P is, for example, the total number of paper sheets P or the total amount of money of paper sheets P in a case where the paper sheets P are banknotes.

Figure 3:
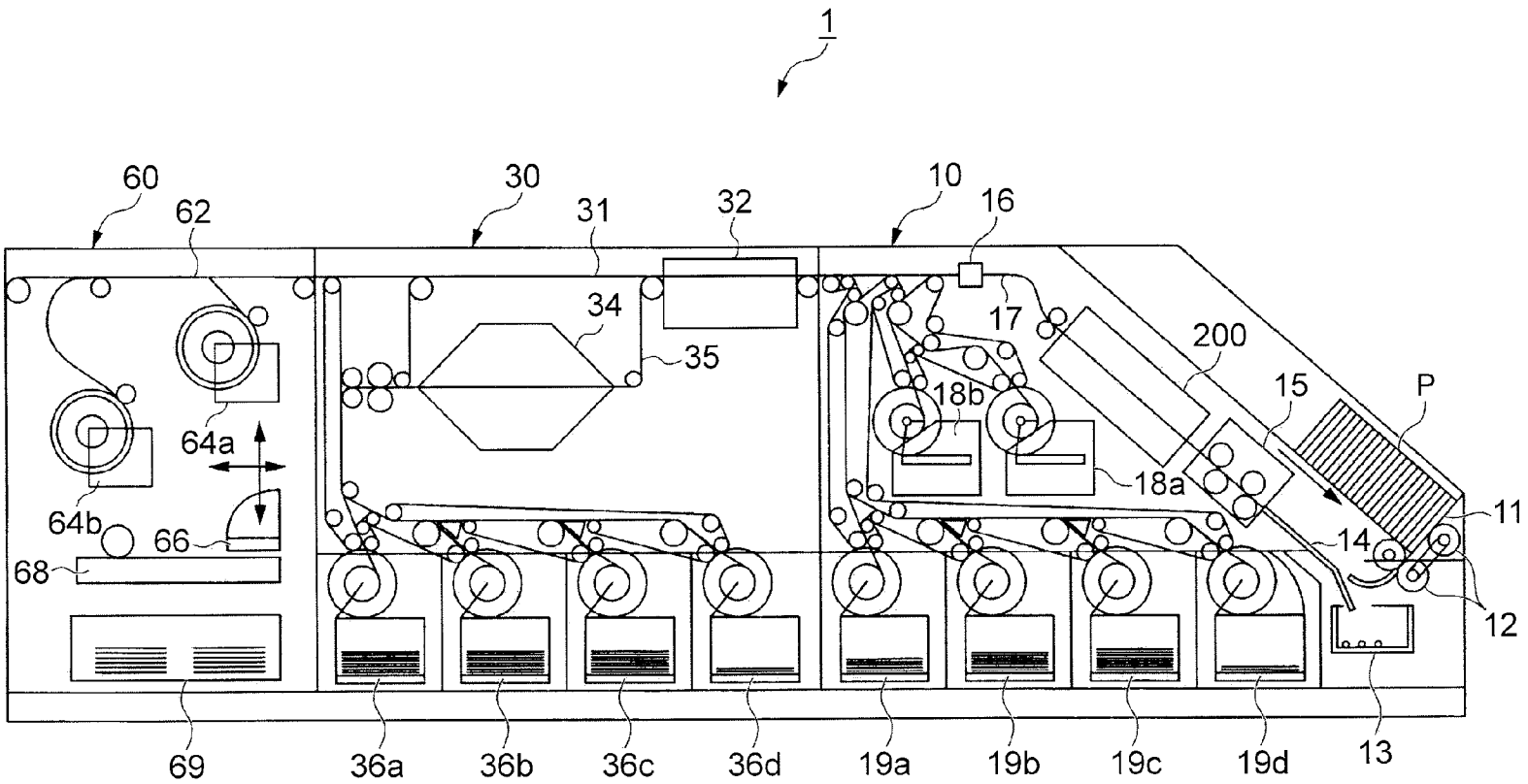
FIG. 3 is a figure schematically illustrating an entire configuration of a paper sheet processing apparatus 1 according to the embodiment.

FIG. 3 is a figure schematically illustrating an entire configuration of the paper sheet processing apparatus 1 according to the embodiment. First, distributing processing of paper sheets P with the paper sheet processing apparatus 1 will be explained. As shown in FIG. 3, the main module 10 includes a supply unit 11, rollers 12, a conveying path 14, a conveying unit 15, a bar code reader 16, a conveying path 17, rejection units 18*a* and 18*b*, and accumulation cases 19*a*, 19*b*, 19*c*, and 19*d*. Paper sheets P of processing target are stacked on the supply unit 11. The rollers 12 feed the paper sheets P from the supply unit 11 sheet by sheet. The conveying path 14 conveys the paper sheet P fed by the rollers 12. In the conveying path 14, multiple endless conveying belts, not shown, extend to sandwich the conveying path. The paper sheet P fed by the rollers 12 is conveyed in such a manner that the paper sheet P is sandwiched by the conveying belts.

The conveying path 14 is inclined to extend from the position downstream of the rollers 12 toward the determination processing unit 200 (determination device). Therefore, when a foreign object such as a clip, a coin, a pin, and the like are fed from the providing unit 11 to the conveying path 14 together with the paper sheet P, the foreign object drops to the lowermost portion of the conveying path 14 by its gravity. Therefore, this can prevent the foreign object from entering into the determination processing unit 200 and can prevent the determination processing unit 200 from being damaged by the foreign object in advance. A foreign object collection unit 13 is provided at the lowermost portion of the conveying path 14. The foreign object collection unit 13 includes, for example, a collection box that can be drawn out from the apparatus main body. The foreign object dropping along the conveying path 14 drops into and collected by the foreign object collection unit 13.

The conveying unit 15 adjusts the conveying speed of the paper sheets P so that the interval between a paper sheet P and a paper sheet P being conveyed is in a predetermined interval, and conveys the paper sheets P to the determination processing unit 200. The determination processing unit 200 detects the type (kind) of the paper sheet P, the authenticity (true/false) of the paper sheet P, and abnormality of the paper sheet P (tear, fold, contamination, double feed, and the like). The determination processing unit 200 detects an image of a paper sheet P conveyed. The image of the paper sheet P includes a transmission image and a reflection image. Further, the determination processing unit 200 uses an excitation light detection apparatus to detect excitation light emitted from a light emission body printed on a paper sheet P. Further, the determination processing unit 200 detects magnetism emitted from a magnetic body included in the paper sheet P. The determination processing unit 200 determines at least one of the type (kind), the authenticity, the degree of contamination and damage, and the like of the paper sheet P on the basis of the detected image, the excitation light, and the magnetism. The determination processing unit 200 detects the front/back sides of the paper sheet P on the basis of the detected image. Further, the determination processing unit 200 counts the number of paper sheets P (processed bills) which is not determined to be abnormal.

In a case where abnormality of the paper sheet P is detected, the main module 10 conveys the paper sheet P along the conveying path 17, and distributes and accumulates the paper sheet P to the rejection unit 18*a* or 18*b* on the basis of the type of the abnormality determined by the determination processing unit 200. On the other hand, in a case where the determination processing unit 200 does not detect abnormality of the paper sheet P, the main module 10 conveys the paper sheet P along the conveying path 17, and distributes and accumulates the paper sheet P into any one of the accumulation cases 19*a*, 19*b*, 19*c*, and 19*d* on the basis of the type of the paper sheet P.

Specifically, with a gate, not shown, the main module distributes the paper sheet P into a rejected bill (removed bill) and a processed bill. The rejected bills are bills that are determined to be false bills (counterfeit bills) by the determination processing unit 200, or bills that are determined to be indeterminable because of fold, tear, skew, double feed, and the like. The skew is a state in which the paper sheet P is obliquely inclined with respect to the direction perpendicular to the conveying direction. For example, the main module 10 distributes the paper sheet P that is determined to be a false bill into the rejection unit 18*a*, and distributes the paper sheet P that is determined to be an indeterminable bill into the rejection unit 18*b*. The counting result of the determination processing unit 200 about the paper sheet P determined to be the processed bill is transmitted to the first main controller (main controller) 20 of FIG. 5 explained later. The counting result about the processed bill is, for example, the number of paper sheet P for each type of the paper sheet P, the total amount of money of the paper sheets P, and the like.

In a case where the batch card BC is conveyed from the providing unit 11 to the conveying path 17, the main module 10 reads the bar code BCa with the bar code reader 16. The bar code reader 16 analyzes information about the bar code BCa, and transmits information including the batch card number, the account number, and the total quantity of counting of the paper sheets P to the first main controller 20. The total quantity of counting of the paper sheets P is a value declared by a requester who requests processing of the paper sheets P. The above is the distributing processing of the paper sheets P.

Subsequently, aligning processing of the paper sheets P will be explained. The aligning processing for aligning the positions of the paper sheets P and aligning the front and back sides to accumulate the paper sheets P for each type. The aligning module 30 provided between the main module 10 and the sealing module 60 includes conveying paths 31 and 35, an aligning unit 32, a inverting unit 34, and the multiple accumulation cases 36*a*, 36*b*, 36*c*, and 36*d*.

The conveying path 31 conveys the paper sheet P conveyed from the main module 10. The aligning unit 32 aligns the paper sheet P. The aligning unit 32 aligns the center of the paper sheet P fed from the main module 10 with the predetermined reference position in the direction perpendicular to the conveying direction of the paper sheet P. The aligning unit 32 corrects the direction of the paper sheet P so that the leading edge portion of the skewed paper sheet P crosses the conveying direction.

The inverting unit 34 is provided at the downstream side in the conveying direction with respect to the aligning unit 32, and reverses the front and back sides of the paper sheet P. The conveying path 35 conveys the paper sheet P to the inverting unit 34. When the aligning processing of the paper sheet P is performed, it is necessary to align the front and back sides of each paper sheet P. Therefore, the determination processing unit 200 reads the image of the paper sheet P, detects the front and back sides of the paper sheet P, and transmits the detection result to the aligning module 30. The aligning module 30 switches the operation as to whether to reverse the front and back sides of the paper sheet P by using the inverting unit 34 in accordance with the detection result of the front and back sides given by the determination processing unit 200.

In a case where the aligning module 30 does not reverse the front and back sides of the paper sheet P, the aligning module 30 conveys the paper sheet P along the conveying path 31, and distributes and accumulates the paper sheet P into the accumulation case 36*a*, 36*b*, 36*c*, or 36*d* on the basis of the type of the paper sheet P. On the other hand, in a case where the aligning module 30 reverses the front and back sides of the paper sheet P, the aligning module 30 conveys the paper sheet P along the conveying path 35. The inverting unit 34 has a twist conveying path provided therein, and reverses the front and back sides of the paper sheet P while conveying the paper sheet P. Thereafter, the aligning module 30 conveys the paper sheet P of which front and back sides are reversed by the inverting unit 34, and distributes and accumulates the paper sheet P into the accumulation case 36*a*, 36*b*, 36*c*, or 36*d* on the basis of the type of the paper sheet P. The above is the aligning processing of the paper sheet P.

It should be noted that the aligning module 30 may return the paper sheet P, of which direction has been aligned, back to the main module 10, and distribute and accumulate the paper sheet P into the accumulation case 19*a*, 19*b*, 19*c*, or 19*d*. The accumulation cases 36*a*, 36*b*, 36*c*, and 36*d* in the aligning module 30 may be used as a rejection unit accumulating the paper sheets P which is determined to be abnormal.

Subsequently, sealing processing of the paper sheets P will be explained. The sealing processing is processing for holding a bundle of 100 paper sheets P with a band. In the embodiment, a predetermined number, i.e., 100, of paper sheets P is processed, but the embodiment is not limited thereto. The sealing module 60 includes a conveying path 62, a first accumulation unit 64*a*, a second accumulation unit 64*b*, a conveying tray 66, a sealing unit 68, and a discharge unit 69. The conveying path 62 is connected to the conveying path 31 of the aligning module 30. Each of the first accumulation unit 64*a* and the second accumulation unit 64*b* accumulates 100 paper sheets P. The conveying tray 66 conveys a bundle of 100 paper sheets P. The sealing unit 68 seals a bundle of 100 paper sheets P with a band. The second accumulation unit 64*b* is arranged with a deviation in an obliquely lower direction with respect to the first accumulation unit 64*a*, and the sealing unit 68 is arranged below the second accumulation unit 64*b*. Further, the discharge unit 69 receiving and accumulating the bundle of 100 paper sheets P sealed by the sealing unit 68 is provided below the sealing unit 68.

The sealing module 60 conveys the paper sheet P to any one of the first accumulation unit 64*a* and the second accumulation unit 64*b* on the basis of, for example, the type of the paper sheet P conveyed from the aligning module 30. The first accumulation unit 64*a* and the second accumulation unit 64*b* accumulates 100 paper sheets P having been conveyed.

The conveying tray 66 is provided in a movable manner in arrow direction of FIG. 3. When a predetermined number of paper sheets P is accumulated on the first accumulation unit 64*a*, the conveying tray 66 moves to the position of the first accumulation unit 64*a*, and receives the bundle of 100 paper sheets P. When the predetermined number of paper sheets P are accumulated on the second accumulation unit 64*b*, the conveying tray 66 moves to the position of the second accumulation unit 64*b*, and receives the bundle of 100 paper sheets P.

After the conveying tray 66 receives the bundle of 100 paper sheets P, the conveying tray 66 goes down to the position of the sealing unit 68, and gives the bundle of 100 paper sheets P to the sealing unit 68. The sealing unit 68 wraps a band around the bundle of 100 paper sheets P received from the conveying tray 66. The sealing unit 68 prints predetermined information on the band of the bundle of 100 paper sheets P. The information printed on the band is, for example, date and time, a serial number, a logotype of a bank, or the like. Such information is printed by using, for example, an ink jet printer, a dot printer, a laser printer, or the like. After the printing on the band is finished, the sealing unit 68 discharges the bundle of 100 paper sheets P to the discharge unit 69 connected with the take out port 60A. It should be noted that the sealing unit 68 changes the position on the basis of the type of the paper sheet P and discharges the bundle of 100 paper sheets P. The above is the sealing processing of the paper sheets P.

Figure 4:
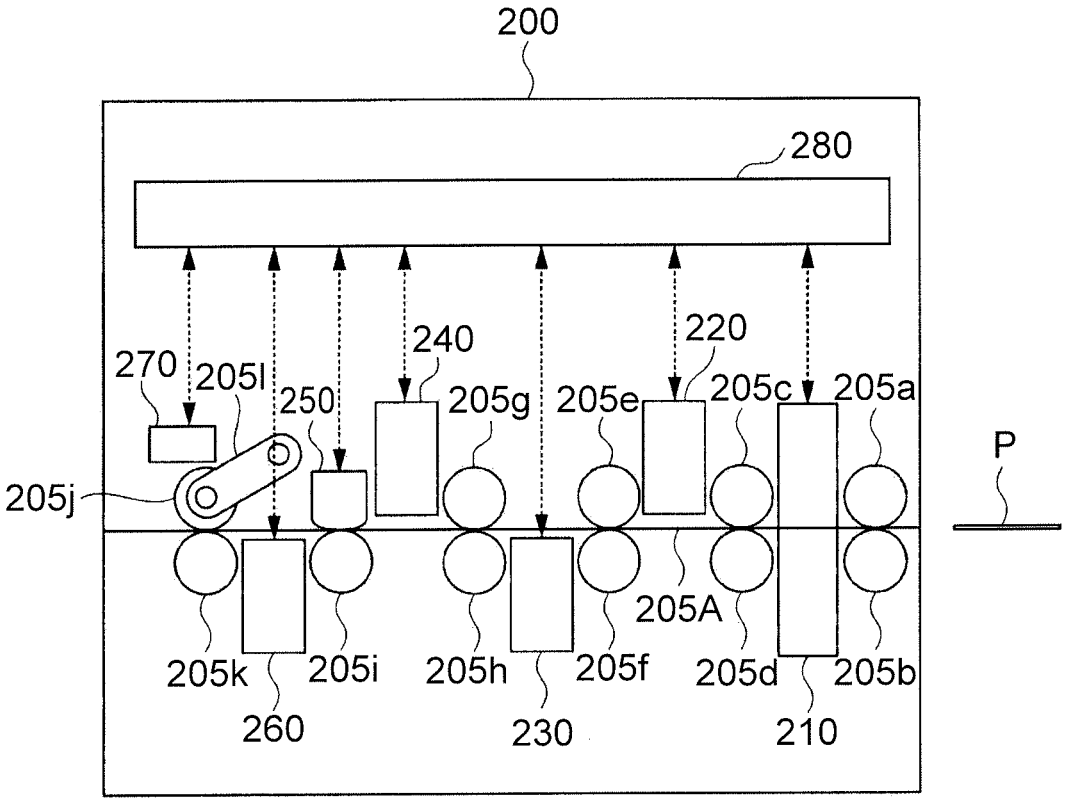
FIG. 4 is a figure schematically illustrating a configuration of a determination processing unit 200 according to the embodiment.

The determination processing unit 200 will be hereinafter explained. FIG. 4 is a figure schematically illustrating a configuration of the determination processing unit 200 according to the embodiment. The determination processing unit 200 includes multiple conveying rollers 205*a*, 205*b*, 205*c*, 205*d*, 205*e*, 205*f*, 205*g*, 205*h*, 205*i*, 205*j*, and 205*k*. The determination processing unit 200 provides driving torque to each conveying roller from a motor and the like (not shown), and rotates and drives each conveying roller. Accordingly, in the determination processing unit 200, the paper sheets P are conveyed from the right side to the left side in the drawing along the conveying path 205A at a predetermined conveying speed. In the present embodiment, the paper sheet P is conveyed with the upper surface facing upward in the drawing and the lower surface facing downward in the drawing.

The determination processing unit 200 includes, for example, a transmission image detection unit 210, an upper surface reflection image detection unit 220, a lower surface reflection image detection unit 230, an upper surface excitation light detection unit 240, a magnetism detection unit 250, a lower surface excitation light detection unit 260, a thickness detection unit 270, and a detection information processing unit 280.

The transmission image detection unit 210 detects the transmission image of the paper sheet P. The transmission image detection unit 210 includes, for example, a light source arranged on the upper surface of the paper sheet P and an image sensor arranged on the lower surface of the paper sheet P. The transmission image detection unit 210 causes the light source to emit light at a point in time when the paper sheet P is conveyed, and detects the light having transmitted through the paper sheet P with the image sensor. Therefore, the transmission image detection unit 210 generates a transmission image signal with an image sensor. The transmission image detection unit 210 provides the generated transmission image signal to the detection information processing unit 280.

The upper surface reflection image detection unit 220 detects the reflection image on the upper surface of the paper sheet P. The upper surface reflection image detection unit 220 includes, for example, a light emission unit and a light reception unit arranged on the upper surface of the paper sheet P. The light emission unit is an LED array in which, for example, multiple LEDs (Light Emitting Diodes) are arranged in a row. The LED is visible light or near-infrared light. The light reception unit is a photo diode array arranged with photo diodes corresponding to the LED array, or a one-dimensional image reading sensor having a CCD (Charge Coupled Device).

The upper surface reflection image detection unit 220 causes the light emission unit to emit light at a point in time when the paper sheet P is conveyed, and detects reflection light from the upper surface of the paper sheet P with the light reception unit. The upper surface reflection image detection unit 220 generates an upper surface reflection image signal with every predetermined width in the conveying direction. The upper surface reflection image detection unit 220 provides the generated upper surface reflection image signal to the detection information processing unit 280.

The lower surface reflection image detection unit 230 detects the reflection image on the lower surface of the paper sheet P. The lower surface reflection image detection unit 230 includes, for example, a light emission unit and a light reception unit arranged on the lower surface of the paper sheet P. The light emission unit and the light reception unit are configured in the same manner as the upper surface reflection image detection unit 220. The lower surface reflection image detection unit 230 causes the light emission unit to emit light at a point in time when the paper sheet P is conveyed, and detects the reflection light from the lower surface of the paper sheet P with the light reception unit. The lower surface reflection image detection unit 230 generates a lower surface reflection image signal with every predetermined width in the conveying direction. The lower surface reflection image detection unit 230 provides the generated lower surface reflection image signal to the detection information processing unit 280.

The upper surface excitation light detection unit 240 detects the excitation light of the upper surface of the paper sheet P. The excitation light detected by the upper surface excitation light detection unit 240 includes fluorescence and phosphorescence. The upper surface excitation light detection unit 240 provides an upper surface fluorescence signal indicating fluorescence detected on the upper surface of the paper sheet P to the detection information processing unit 280. The upper surface excitation light detection unit 240 provides an upper surface phosphorescence signal indicating phosphorescence detected on the upper surface of the paper sheet P to the detection information processing unit 280.

The magnetism detection unit 250 detects magnetism characteristics of the paper sheet P. The magnetism characteristics are, for example, the amount of magnetic body included in the paper sheet P. The magnetism detection unit 250 is, for example, a magnetic head. The magnetic head has, for example, a configuration in which a primary coil and a secondary coil are wound in the opposite directions on a core (iron core). The magnetic head provides a direct current bias current to the primary coil, and uses the secondary coil to detect a change in the magnetic flux when the magnetic body included in the paper sheet P passes. Therefore, the magnetic head generates a magnetism signal that changes in accordance with the amount of the magnetic body of the paper sheet P. The magnetism detection unit 250 provides the generated magnetism signal to the detection information processing unit 280.

The lower surface excitation light detection unit 260 detects the excitation light on the lower surface of the paper sheet P. The excitation light detected by the lower surface excitation light detection unit 260 includes fluorescence and phosphorescence. The lower surface excitation light detection unit 260 provides the lower surface fluorescence information indicating fluorescence detected on the lower surface of the paper sheet P to the detection information processing unit 280. The lower surface excitation light detection unit 260 provides the lower surface phosphorescence signal indicating phosphorescence detected on the lower surface of the paper sheet P to the detection information processing unit 280.

The thickness detection unit 270 detects the thickness of the paper sheet P. In the thickness detection unit 270, a shaft of a conveying roller 205*j* is connected to an arm 2051 of which one of arm end portions is connected to another rotation shaft. The conveying roller 205*j* moves in a direction away from a conveying roller 205*k* in accordance with the thickness of the conveyed paper sheet P. The thickness detection unit 270 detects the thickness of the paper sheet P by detecting the amount of movement of the conveying roller 205*j*. The thickness detection unit 270 provides the thickness detection signal indicating the thickness of the paper sheet P to the detection information processing unit 280 with each predetermined width in the conveying direction.

The detection information processing unit 280 is connected to the transmission image detection unit 210, upper surface reflection image detection unit 220, the lower surface reflection image detection unit 230, the upper surface excitation light detection unit 240, the magnetism detection unit 250, the lower surface excitation light detection unit 260, and the thickness detection unit 270. The signal which is output from each detection unit is input into the detection information processing unit 280. The detection information processing unit 280 performs A/D conversion processing on the output signal. The detection information processing unit 280 generates detection information by applying processing such as correction processing in accordance with data on which A/D conversion processing has been performed. The detection information processing unit 280 determines the type of the paper sheet P, direction, authenticity, the degree of contamination and damage, or the like on the basis of the generated detection information.

Figure 5:
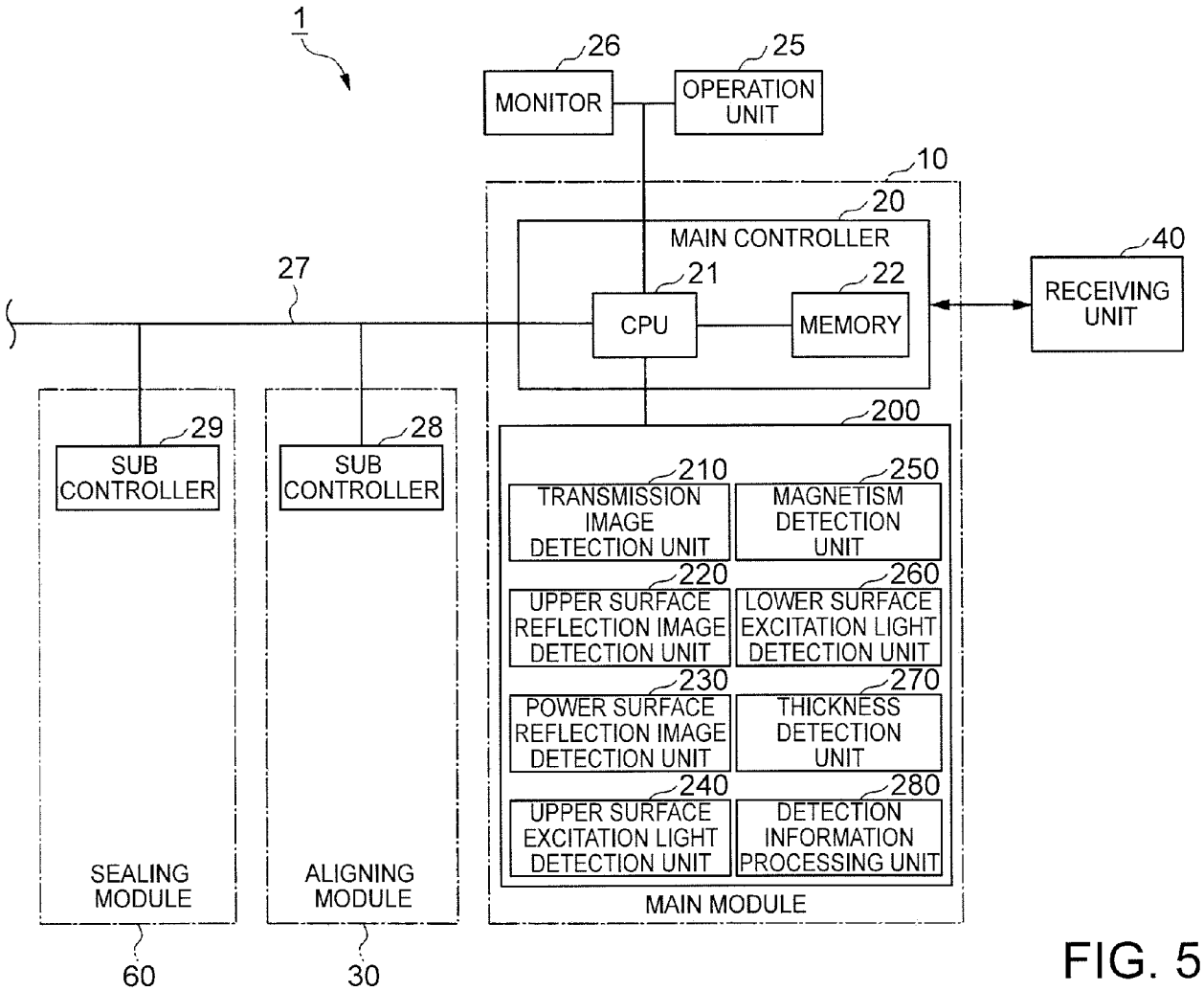
FIG. 5 is a block diagram illustrating a paper sheet processing apparatus 1 according to the embodiment.

FIG. 5 is a block diagram illustrating the paper sheet processing apparatus 1 according to the embodiment. The main module 10 includes a first main controller 20 controlling the entire operation of the paper sheet processing apparatus 1. The first main controller 20 is achieved by causing, for example, a processor such as a CPU (Central Processing Unit) to execute a program stored in a program memory. The first main controller 20 may be achieved with hardware such as an LSI (Large Scale Integration), an ASIC (Application Specific Integrated Circuit), an FPGA (Field-Programmable Gate Array), or the like. The first main controller 20 includes, for example, a CPU 21 controlling operation of each module and a memory 22 storing a control program, management information, and the like. The CPU 21 is connected to the determination processing unit 200, and transmits and receives various kinds of information such as a counting result of processed bills. Various kinds of sensor and motors in the main module 10, which are not shown, are connected to the CPU 21, and the CPU controls conveying operation and the like of the paper sheet P in the main module 10.

The first main controller 20 is connected to an operation unit 25 receiving operator's operation, a monitor 26, and a receiving unit 40. Operator's operation information received by the operation unit 25 is provided to the first main controller 20. The first main controller 20 controls the monitor 26 to display various kinds of information. The receiving unit 40 is connected to the paper sheet counting apparatus 100 of FIG. 1 via the communication cable 50. The receiving unit 40 outputs the received information to the first main controller 20. The first main controller 20 calculates the counting result of the paper sheets P on the basis of the determination result of the determination processing unit 200, information received by the operation unit 25, and information received by the receiving unit 40.

The aligning module 30 includes a sub controller 28 controlling operation of the aligning module 30. The sealing module 60 includes a sub controller 29 for controlling operation of the sealing module 60. The sub controller 28 and the sub controller 29 are connected via a LAN (Local Area Network) cable 27 to the first main controller 20 of the main module 10. The CPU 21 transmits an operation command of the aligning module 30 to the sub controller 28, and transmits an operation command of the sealing module 60 to the sub controller 29.

Figure 6:
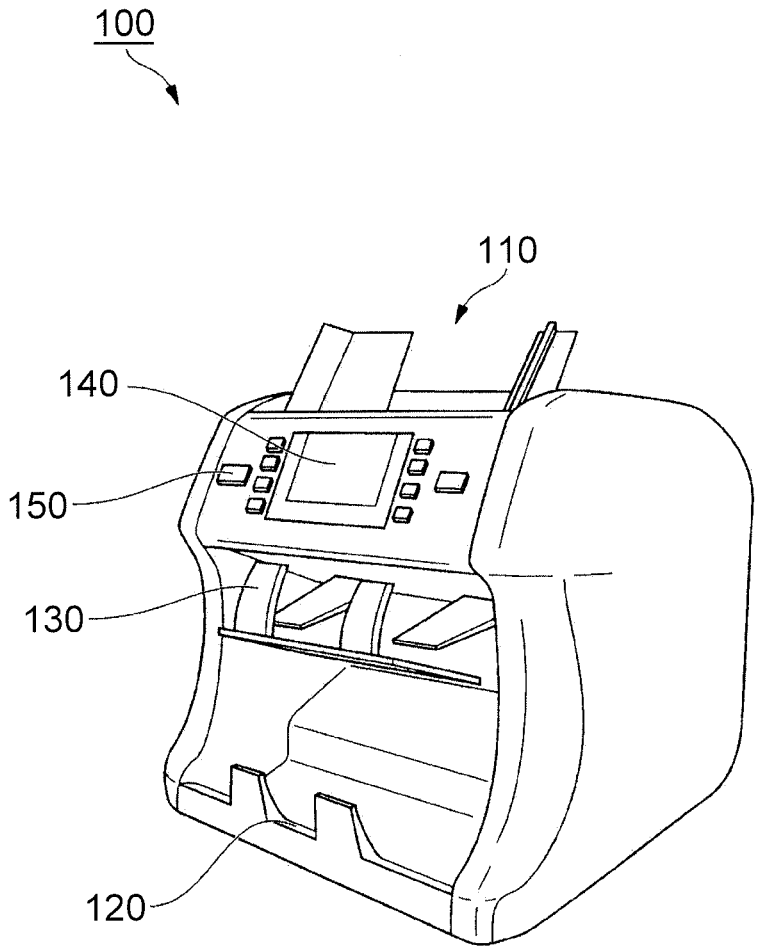
FIG. 6 is a configuration diagram illustrating an external view of a paper sheet counting apparatus 100 according to an embodiment.
Figure 7:
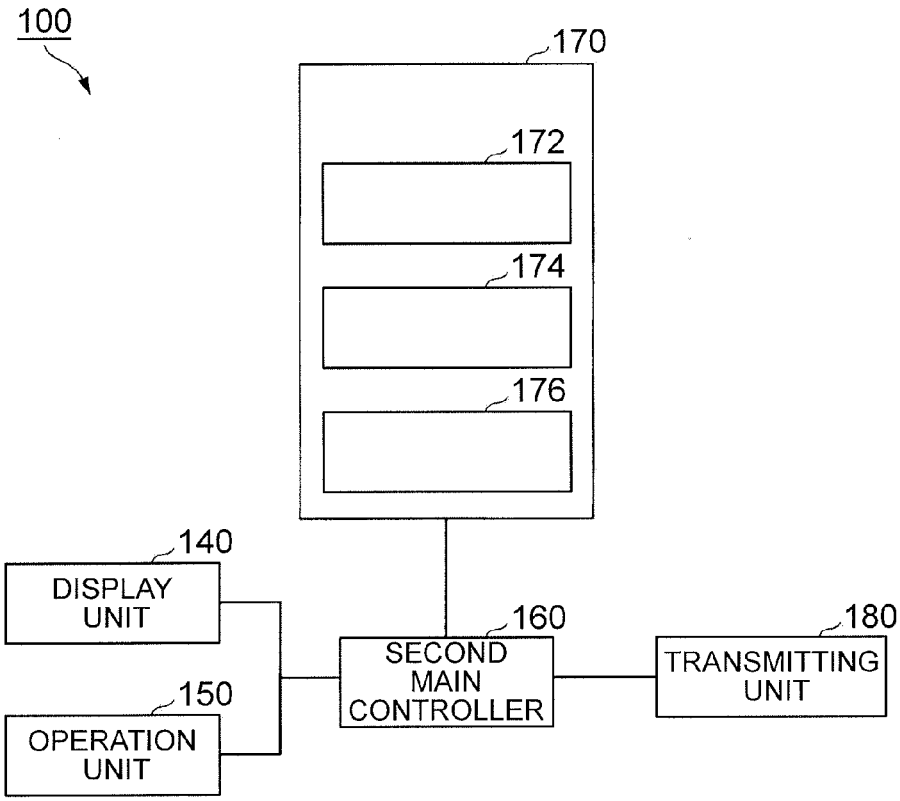
FIG. 7 is a configuration diagram illustrating functions of the paper sheet counting apparatus 100 according to the embodiment.

Hereinafter, the paper sheet counting apparatus 100 will be explained. FIG. 6 is a configuration diagram illustrating the external view of the paper sheet counting apparatus 100 according to the embodiment. FIG. 7 is a configuration diagram illustrating the functions of the paper sheet counting apparatus 100 according to the embodiment. As shown in FIG. 6, the paper sheet counting apparatus 100 includes, for example, a supply unit 110, an accumulation unit 120, a discharge unit 130, a display unit 140, and an operation unit 150. The paper sheet counting apparatus 100 is smaller than the paper sheet processing apparatus 1, and performs counting processing on the paper sheets P placed by the operator.

The supply unit 110 includes, for example, a tray on which paper sheets P are placed and a conveying roller. When the operator puts the paper sheets P and operates the operation unit 150, the supply unit 110 takes in the paper sheets P. The accumulation unit 120 accumulates the paper sheets P. The paper sheets P, which have been subjected to the counting process by the paper sheet counting apparatus 100, are conveyed to the accumulation unit 120. The discharge unit 130 is a tray with which the paper sheets P transferred by the paper sheet counting apparatus 100 are conveyed. Among paper sheets P that are stacked on the supply unit 110, paper sheets P that have not been subjected to the counting processing are conveyed to the discharge unit 130. The display unit 140 is a liquid crystal display displaying various kinds of information. The operation unit 150 includes buttons and the like for receiving operator's operation.

As shown in FIG. 7, the paper sheet counting apparatus 100 includes, for example, a second main controller 160, a counting unit 170 (counting device), and a transmitting unit 180. The second main controller 160 is achieved by causing, for example, a processor such as a CPU and the like to execute a program stored in a program memory. The second main controller 160 may be achieved with hardware such as an LSI, an ASIC, an FPGA, or the like. The second main controller 160 controls the counting unit 170 and the transmitting unit 180.

The counting unit 170 includes, for example, a conveying unit 172, a determination unit 174 (determination device), and a conveying control unit 176. The conveying unit 172 includes a conveying belt, a conveying roller, a conveying motor, and the like. The conveying unit 172 takes in the paper sheets P placed on the supply unit 110, and conveys the paper sheets P to the determination unit 174. The determination unit 174 includes, for example, a detection apparatus such as an image sensor, a magnetic sensor, and the like. The determination unit 174 determines the type of the paper sheet P on the basis of a detection result of the detection apparatus, and outputs the determination result to the second main controller 160. The conveying control unit 176 distributes the paper sheets P into the accumulation unit 120 or the discharge unit 130 on the basis of the determination result of the determination unit 174. The conveying control unit 176 distributes the paper sheets P, of which type of the paper sheets P have been determined by the determination unit 174, to the accumulation unit 120, and distributes the paper sheets P, of which type of the paper sheets P have not been determined by the determination unit 174, to the discharge unit 130.

The second main controller 160 counts the paper sheets P on the basis of the determination result of the determination unit 174. For example, the second main controller 160 counts the number of paper sheets P for each type (kind) of paper sheet P. The second main controller 160 uses the transmitting unit 180 to transmit the counting result of the paper sheets P. As a result, the counting result of the paper sheets P provided by the second main controller 160 is transmitted from the transmitting unit 180 to the receiving unit 40, and received by the receiving unit 40.

Figure 8:
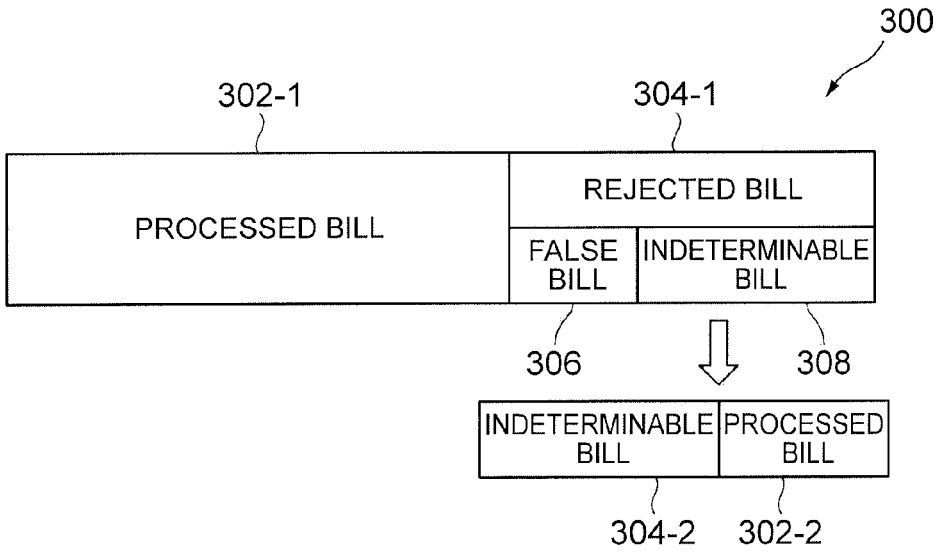
FIG. 8 is a figure illustrating a counting result of the paper sheet processing apparatus 1 according to the embodiment and a counting result of the paper sheet counting apparatus 100 according to the embodiment.

Hereinafter, the counting result of the paper sheets P of the paper sheet processing system according to the embodiment will be explained. FIG. 8 is a figure illustrating a counting result given by the paper sheet processing apparatus 1 according to the embodiment, and a counting result given by the paper sheet counting apparatus 100 according to the embodiment. A counting result 300 of the paper sheets P given by the paper sheet processing system includes the counting result of the paper sheets P given by the paper sheet processing apparatus 1 and the counting result of the paper sheets P given by the paper sheet counting apparatus 100. The counting result of the paper sheets P given by the paper sheet processing apparatus 1 is a counting result 302-1 of processed bills (true bills (genuine bills)). The counting result 302-1 of the processed bills is generated by the determination processing unit 200. The counting result 304-1 of rejected bills is a summation of a counting result 306 of false bills (counterfeit bills)) and a counting result 308 of indeterminable bills that are determined to be abnormal (tear, fold, contamination, skew, double feed). The counting result 306 of the false bills are received by the paper sheet processing apparatus 1 through operation with the operation unit 25 on the basis of a manual counting result produced from a manual work by the operator. The counting result 308 of the indeterminable bills includes the counting result 302-2 of the processed bills given by the paper sheet counting apparatus 100 and the counting result 304-2 of the indeterminable bills. The counting result 302-2 of the processed bills is generated by the determination unit 174. The counting result 304-2 of the indeterminable bills is received by the paper sheet processing apparatus 1 through operation with the operation unit 25 on the basis of a manual counting result produced from a manual work by the operator. As a result of the processing with the paper sheet counting apparatus 100, many of the paper sheets P skewed and double fed by the paper sheet processing apparatus 1 may be recognized as processed bills (true bills) 302-2. That is, the paper sheet counting apparatus 100 classifies the paper sheets P, which have been determined to be indeterminable bills 308 by the paper sheet processing apparatus 1, into the processed bills 302-2 (true bills) and the indeterminable bills 304-2 (damaged bills) such as tear, fold, contamination, and the like.

Figure 9:
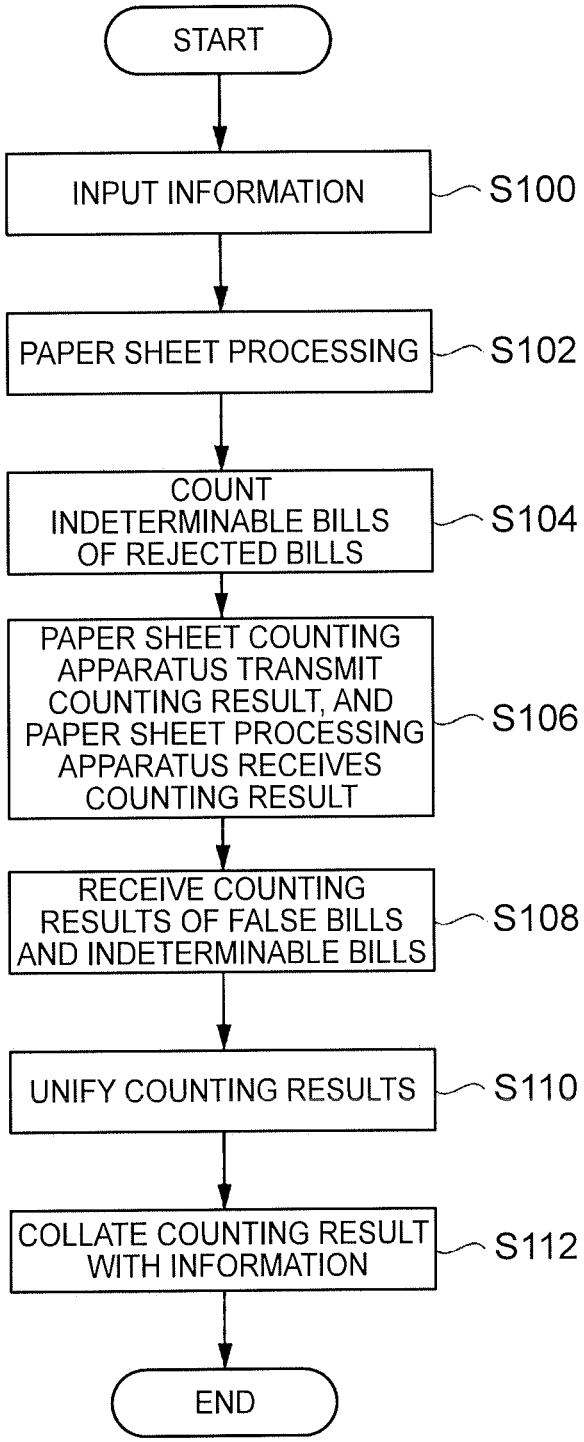
FIG. 9 is a flowchart illustrating a flow of processing of the entire paper sheet processing system according to the embodiment.

Hereinafter, the counting result of the paper sheets P in the paper sheet processing system according to the embodiment will be explained. FIG. 9 is a flowchart illustrating a flow of processing of the entire paper sheet processing system according to the embodiment (paper sheet processing method). For example, the processing of FIG. 9 is carried out for each of multiple paper sheets P having a batch card BC inserted therein.

The paper sheet processing apparatus 1 according to the embodiment receives information about the paper sheets P to be processed (step S100). For example, the paper sheet processing apparatus 1 uses the bar code reader 16 to decode the bar code BCa, thus receiving information about the account number, the total quantity of counting of the paper sheets P, and the like. It should be noted that information about the paper sheets P to be processed may be information transmitted from an external apparatus operated by the requester who requests processing of the paper sheets P.

Subsequently, the paper sheet processing apparatus 1 processes the paper sheets P which are to be processed (step S102). Among paper sheets P to be processed, the paper sheet processing apparatus 1 causes false bills to be accumulated on the rejection unit 18*a*, and causes indeterminable bills to be accumulated on the rejection unit 18*b*.

Subsequently, for example, the indeterminable bills accumulated on the rejection unit 18*b* are stacked on the supply unit 110 of the paper sheet counting apparatus 100 through manual work of the operator. The paper sheet counting apparatus 100 counts the paper sheets P stacked on the supply unit 110 (step S104). The paper sheet counting apparatus 100 accumulates, on the accumulation unit 120, the paper sheets P that are stacked on the supply unit 110 and that has been counted, and discharges the paper sheets P that have not been counted to the discharge unit 130. The paper sheet counting apparatus 100 causes the transmitting unit 180 to transmit the counting result 302-2 of the processed bills to the paper sheet processing apparatus 1, and the paper sheet processing apparatus 1 receives the counting result 302-2 of the processed bills by the receiving unit 40. (step S106). The counting result 302-2 of the processed bills transmitted from the transmitting unit 180 may be information in which the type of sheets and the total quantity of counting based on the number of sheets are associated with each other, and may be information in which the type of bills and the total amount are associated with each other in a case where the paper sheets P are banknotes.

The false bills accumulated on the rejection unit 18*a* and the indeterminable bills discharged to the discharge unit 130 are counted through manual work by the operator. The paper sheet processing apparatus 1 receive the counting result 306 of the false bills counted through manual work and the counting result 304-2 of the indeterminable bills discharged to the discharge unit 130 on the basis of the operation with the operation unit 25 (step S108).

The first main controller 20 unifies the counting result 302-1 of the processed bills, the counting result 302-2 of the paper sheet counting apparatus 100, the counting result 306 of the false bills, and the counting result 304-2 of the indeterminable bills, thus obtaining the counting result 300 of the paper sheets P to be processed (step S110). The first main controller 20 collates information received in step S100 and the counting result 300 of the paper sheets P to be processed (step S112). For example, the first main controller 20 displays the collated result on the monitor 26.

Figure 10:
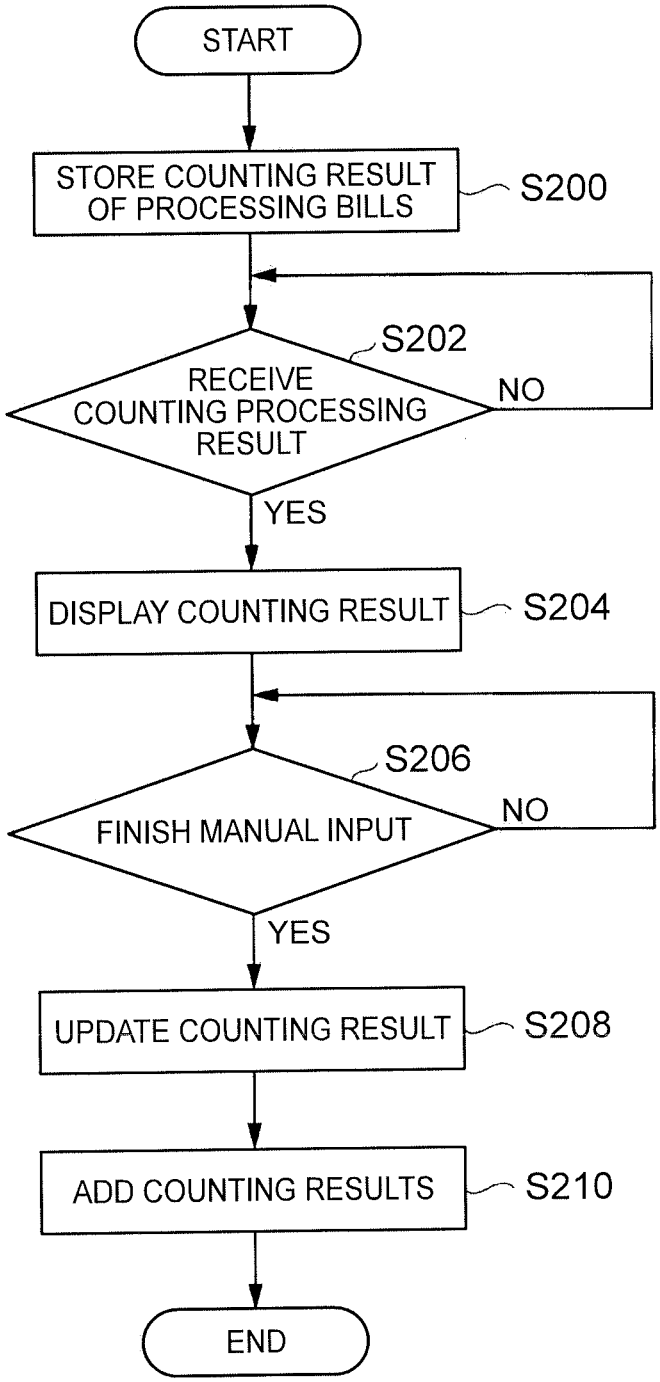
FIG. 10 is a flowchart illustrating a flow of processing for generating a counting result 300 of a paper sheet P of processing target in the paper sheet processing apparatus 1 according to the embodiment.

FIG. 10 is a flowchart illustrating a flow of processing for generating the counting result 300 of the paper sheets P to be processed in the paper sheet processing apparatus 1 according to the embodiment. First, the first main controller 20 stores the counting result 302-1 of the processed bills generated by the determination processing unit 200 in step S102 to the memory 22 of the first main controller 20 (step S200). Subsequently, the first main controller 20 determines whether the counting result 302-2 of the processed bills transmitted by the paper sheet counting apparatus 100 has been received or not (step S202).

Figure 11:
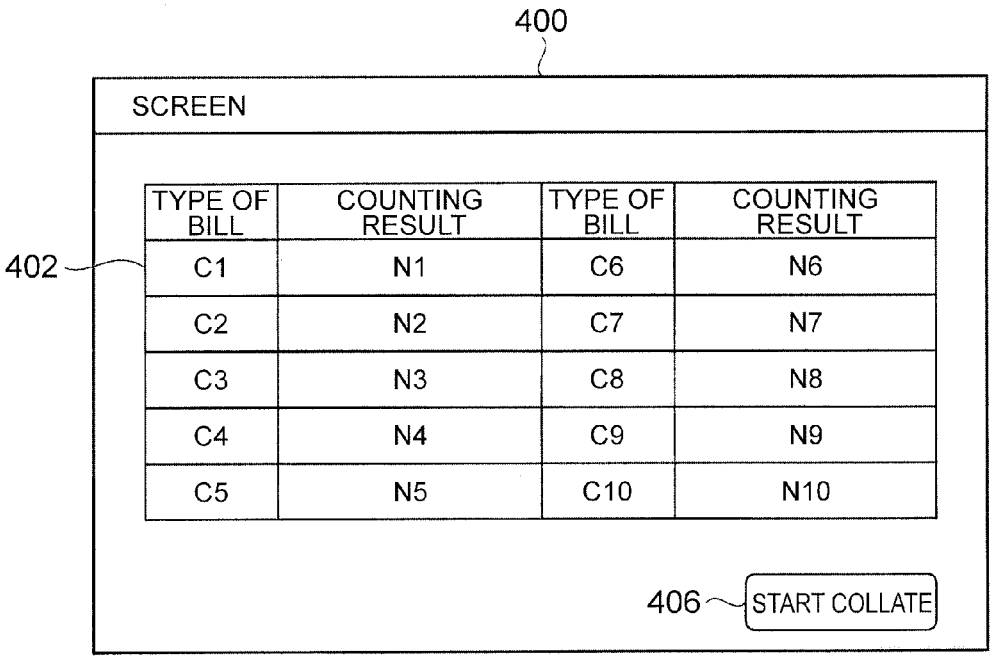
FIG. 11 is a figure illustrating an example of a screen 400 displayed on the paper sheet processing apparatus 1 according to the embodiment.

In a case where the counting result 302-2 of the processed bills are determined not to have been received, the first main controller 20 waits, and in a case where the counting result 302-2 of the processed bills are determined to have been received, the first main controller 20 displays the counting result (step S204). The first main controller 20 displays the received counting result 302-2 of the processed bills as the counting result counted by the paper sheet counting apparatus 100. FIG. 11 is a figure illustrating an example of a screen 400 displayed on the paper sheet processing apparatus 1 according to the embodiment. The screen 400 includes, for example, an association table 402 of the type of sheets and the counting result, and a collation start button 406. The first main controller 20 updates the counting result corresponding to the type of the sheet in the association table 402 on the basis of the counting result 302-2 of the processed bills received by the receiving unit 40.

The first main controller 20 determines whether manual input of the counting result 306 of the false bills and the counting result 304-2 of the indeterminable bills has been finished or not on the basis of the operation received with the operation unit 25 (step S206). For example, when the type of the sheet in the association table 402 is designated on the basis of operator's operation, and the first main controller 20 receives input of numbers corresponding to the counting result 306 of the false bills and the counting result 304-2 of the indeterminable bills, the first main controller 20 adds the received numbers, and stores information about the counting result 306 of the false bills and the counting result 304-2 of the indeterminable bills to the memory 22. Thereafter, in a case where the first main controller 20 receives an operation for designating the collation start button 406, the first main controller 20 determines that the manual input is finished. In a case where the first main controller 20 determines that the manual input has been finished, the first main controller 20 proceeds to processing in step S208. In a case where the first main controller 20 determines that the manual input has not been finished, the first main controller 20 waits.

The first main controller 20 adds the counting result 306 of the false bills and the counting result 304-2 of the indeterminable bills, which have been manually input, to the counting result 302-2 of the processed bills, and updates the counting result in the association table 402 (step S208). Accordingly, the first main controller 20 displays the added counting result on the monitor 26 as the number of paper sheets P received by the operation unit 25.

The first main controller 20 adds the counting result 302-1 of the processed bills stored in step S200, the counting result 302-2 of the processed bills, the counting result 306 of the false bills and the counting result 304-2 of the indeterminable bills, thus calculating the counting result 300 of the paper sheets P (step S210), and stores it to the memory 22.

According to the paper sheet processing system according to the first embodiment explained above, the paper sheets P determined to be false bills are accumulated on the rejection unit 18*a*, the paper sheets P determined to be indeterminable bills are accumulated on the rejection unit 18*b*, the paper sheets P accumulated on the rejection unit 18*b* are counted by the paper sheet counting apparatus 100, and the counting result 302-2 of the processed bills can be transmitted to the paper sheet processing apparatus 1. Therefore, according to the paper sheet processing system according to the first embodiment, it is not necessary to count all of the paper sheets P determined to be indeterminable bills through manual work, and the processing efficiency of the paper sheets P can be improved.

According to the paper sheet processing system according to the first embodiment, the paper sheet counting apparatus 100 does not count the false bills accumulated on the rejection unit 18*a*. Instead, the false bills accumulated on the rejection unit 18*a* are counted through manual work. Therefore, the determination performance for determining false bills is not deteriorated as the paper sheet processing system. That is, in a case where the paper sheets P accumulated on both of the rejection units 18*a* and 18*b* are processed by the paper sheet counting apparatus 100, the false bills are determined on the basis of the determination result of the paper sheet counting apparatus 100. In contrast, according to the paper sheet processing system according to the first embodiment, the false bills accumulated on the rejection unit 18*a* are counted through operator's work, and the paper sheets P that are not the false bills are counted by the paper sheet counting apparatus 100. Therefore, this can prevent the determination performance of the paper sheet processing system for determining the false bills from being reduced to a level lower than the determination performance of the paper sheet processing apparatus 1 for determining the false bills.

According to the paper sheet processing system according to the first embodiment, the counting result 302-2 of the processed bills transmitted by the paper sheet counting apparatus 100 are added to the counting result 306 of the false bills and the counting result 304-2 of the indeterminable bills which are manually input, and the added counting result is displayed. Therefore, according to the paper sheet processing system according to the first embodiment, the operator is allowed to confirm the counting result of the paper sheet counting apparatus 100 as the manually input counting result.

Second Embodiment

A paper sheet processing system according to the second embodiment will be explained. In the following explanation, the matters described in the first embodiment are denoted with the same reference numerals, and detailed explanation thereabout is omitted. The paper sheet processing system according to the second embodiment is different from the first embodiment in that the paper sheet counting apparatus 100 reads information encoded in the bar code BCa of the batch card BC and transmits the information read by the paper sheet counting apparatus 100 to the paper sheet processing apparatus 1.

In the paper sheet processing system according to the second embodiment, for example, the main module 10 conveys a batch card BC, which is detected to be the batch card BC by the determination processing unit 200, to the rejection unit 18*a* or the rejection unit 18*b*. Then, the batch card BC is stacked on the supply unit 110 of the paper sheet counting apparatus 100 through operator's manual work. In a case where the batch card BC is conveyed, the determination unit 174 reads the batch card BC, and outputs the reading information to the second main controller 160. The second main controller 160 analyzes the reading information, decodes the information encoded in the bar code BCa, and causes the transmitting unit 180 to transmit the information to the receiving unit 40. Therefore, the paper sheet processing apparatus 1 causes the receiving unit 40 to receive the information encoded in the bar code BCa.

In step S100, the paper sheet processing apparatus 1 inputs the batch card number, the account number, and the total quantity of counting of the paper sheets P (counting quantity information) included in the information received by the receiving unit 40. The paper sheet processing apparatus 1 stores the counting result 300 of the paper sheets P in association with the batch card number and the account number corresponding to the batch card BC in step S110. In step S112, the paper sheet processing apparatus 1 collates the information on the basis of the counting result 300 of the paper sheets P stored in step S110 and the total quantity of counting of the paper sheets P received by the receiving unit 40.

According to the paper sheet processing system according to the second embodiment explained above, the processing of the batch card BC is performed by the paper sheet counting apparatus 100, and therefore, the paper sheet processing apparatus 1 does not need to perform the processing of the batch card BC, and the processing efficiency of the paper sheets P can be improved.

According to at least one embodiment explained above, it has, a step in which the paper sheet processing apparatus 1 determines the paper sheet P which is to be processed, counts a paper sheet P determined to be a processed bill, and accumulates a paper sheet P determined to be a rejected bill, a step in which the paper sheet counting apparatus 100 counts a rejected bill, and causes the paper sheet processing apparatus 1 to transmit information about the counting result of the rejected bill, a step in which the paper sheet processing apparatus 1 receives the information about the counting result of the rejected bill transmitted by the paper sheet counting apparatus 100, a step of the paper sheet processing apparatus 1 receives operator's operation and inputs the counting result of the paper sheets P, and a step in which the paper sheet processing apparatus 1 calculates the counting result of the paper sheets P, which is to be processed, on the basis of the counting result (302-1) of the processed bill, the counting result (306, or 304-2) of the paper sheet based on operator's operation, and the received information about the counting result (302-2) of the rejected bill are provided, so that the processing efficiency of the rejected bill can be improved, and as a result, the processing efficiency of the paper sheet P which is to be processed can be improved.

The embodiments can also be expressed as follows.

A paper sheet processing method including:

a step in which a paper sheet processing apparatus determines a paper sheet to be processed, counts a paper sheet determined to be a processed bill, and accumulates a paper sheet determined to be a rejected bill;

a step in which a paper sheet counting apparatus counts the rejected bill accumulated on the accumulation unit, and transmits information about a counting result of the rejected bill with the paper sheet processing apparatus;

a step in which the paper sheet processing apparatus receives information about the counting result of the rejected bill transmitted by the paper sheet counting apparatus;

a step of receiving operator's operation and inputting a counting result of a paper sheet; and a step in which the paper sheet processing apparatus calculates a counting result of the paper sheet, which is to be processed, by adding the counting result of the processed bill, the counting result of the paper sheet based on the operator's operation, and the received information about the counting result of the rejected bill.

In the embodiments explained above, false bills accumulated in the rejection unit 18*a* are counted by operator's work, and the paper sheet P accumulated in the rejection unit 18*b* is counted by the paper sheet counting apparatus 100, but the embodiments are not limited thereto. For example, in a case where the ratio of false bills included in the paper sheets P which are to be processed is low, and the paper sheet processing apparatus 1 processes a false bill of a small denomination which less greatly affects the counting result of the paper sheets P, the paper sheet counting apparatus 100 may be caused to count both of the rejection units 18*a* and 18*b* depending on the judgement of the operator or level of the administration. In this case, according to the paper sheet processing system, the processing efficiency of the paper sheet P can be further improved. According to the paper sheet processing system, a processing method in which the paper sheet counting apparatus 100 is caused to count the paper sheets P of one of the rejection units 18*a* and 18*b* and a processing method in which the paper sheet counting apparatus 100 is caused to count the paper sheets P accumulated in both of the rejection units 18*a* and 18*b* may be selectable.

As described above, an embodiment provides the following sheet processing system.

A sheet processing system comprising:

a sheet processing apparatus; and a sheet counting apparatus, wherein the sheet processing apparatus includes:

a conveying unit for conveying a sheet to be processed;

a determination device for determining the sheet conveyed by the conveying unit; and an accumulation unit for accumulating a rejected sheet on the basis of a determination result given by the determination unit, wherein the sheet counting apparatus includes a counting device for counting the paper sheet, and the paper sheet counting apparatus counts the rejected sheet accumulated on the accumulation unit of the sheet processing apparatus, and having a transmitting unit that transmits an information about the counting result to a receiving unit of the paper sheet processing apparatus.

The embodiment may have one or more of the following features.

The sheet processing apparatus includes a main module and a sealing module.

The sheet counting apparatus includes a supply unit, an accumulation unit for accumulating a processed sheet, and a discharge unit for discharging an indeterminable sheet.

The sheet processing apparatus classifies rejected sheets into a false sheet and an indeterminable sheet, and the sheet counting apparatus classifies indeterminable sheets of the sheet processing apparatus into a true sheet and an indeterminable sheet.

The sheet processing apparatus and the sheet counting apparatus are connected in a higher level, and rejected sheet information is added to a processing result of the sheet processing apparatus.

The sheet counting apparatus is a smaller apparatus than the sheet processing apparatus.

The sheet processing system has a monitor. On the screen of the monitor, counting result can be displayed. Concerning the counting result, it is possible to display both of the result of the sheet processing apparatus and the result of sheet counting apparatus. Further, it is possible to display an updated result. For example, counting result of the sheet processing apparatus can be updated by the counting result of the sheet counting apparatus. For example, counting result of the processed sheet 302-1 counted by the sheet processing apparatus can be updated by the sum of the processed sheet 302-1 and 302-2.

As to the material of the sheet, other than a paper, resin, cloth or the like may be used.

In addition, an embodiment provides a sheet processing method.

While certain embodiments have been described, these embodiments have been presented by way of example only, and are not intended to limit the scope of the inventions. Indeed, the novel embodiments described herein may be embodied in a variety of other forms; furthermore, various omissions substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing system comprising:

a sheet processing apparatus; and a sheet counting apparatus, wherein the sheet processing apparatus includes:

a supply unit for setting a sheet;

a conveying unit for conveying the sheet to be processed;

a determination device for determining the sheet conveyed by the conveying unit; and an accumulation unit for accumulating a rejected sheet on the basis of a determination result given by the determination unit, wherein the sheet counting apparatus includes a counting device for counting the paper sheet, and the paper sheet counting apparatus counts again the rejected sheet accumulated on the accumulation unit of the sheet processing apparatus, and having a transmitting unit that transmits an information about the counting result to a receiving unit of the paper sheet processing apparatus, wherein a batch card in the supply unit is conveyed by the conveying unit and is rejected in the sheet processing apparatus.

2. The sheet processing system according to claim 1, wherein the sheet processing apparatus includes a main module and a sealing module.

3. The sheet processing system according to claim 1, wherein the sheet counting apparatus includes a supply unit, an accumulation unit for accumulating a processed sheet, and a discharge unit for discharging an indeterminable sheet.

4. The sheet processing system according to claim 1, wherein the sheet processing apparatus classifies rejected sheets into a false sheet and an indeterminable sheet, and the sheet counting apparatus classifies indeterminable sheets of the sheet processing apparatus into a true sheet and an indeterminable sheet.

5. The sheet processing system according to claim 1, wherein the sheet processing apparatus and the sheet counting apparatus are connected by a communication tool, and rejected sheet information is added to a processing result of the sheet processing apparatus.

6. The sheet processing system according to claim 1, wherein the sheet counting apparatus is a smaller apparatus than the sheet processing apparatus.

7. A sheet processing method comprising:

determining a sheet, and accumulating a rejected sheet, by using a sheet processing apparatus;

counting again the rejected sheet by using a sheet counting apparatus, and transmitting an information about the counting result to the sheet processing apparatus;

calculating a result of the sheet, on the basis of a result of the sheet processing apparatus and the result of the sheet counting apparatus;

wherein, the sheet processing method further including a process of conveying a batch card from a supply unit for setting a sheet of the sheet processing apparatus and rejecting the batch card in the sheet processing apparatus.

8. The sheet processing method according to claim 7, further comprising:

a step of displaying a result on the basis of the result transmitted by the sheet counting apparatus and a counting result input from an operation unit.

9. The sheet processing method according to claim 7, wherein the sheet processing apparatus accumulates a first rejected sheet to a first accumulation unit on the basis of a determination result of the sheet, and accumulates a second rejection sheet to a second accumulation unit on the basis of determination that the sheet is indeterminable, the paper sheet counting apparatus counts the second rejected sheet accumulated in the second accumulation unit, and transmits information about a counting result of the second rejected sheet that has been counted, the sheet processing apparatus receives the information about the counting result of the second rejected sheet, the sheet processing apparatus receives a counting result obtained by counting the first rejected sheet accumulated in the first accumulation unit, on the basis of operator's operation, and the sheet processing apparatus adds the counting result obtained by counting the first rejected sheet and the counting result of the second rejected sheet received from the sheet counting apparatus.

10. The paper sheet processing method according to claim 7, wherein the sheet counting apparatus discharges a second rejected sheet that has not been counted, and an information of the second rejected sheet discharged by the sheet counting apparatus is added to a result.

* * * * *